US008943928B2

(12) United States Patent
Feng

(10) Patent No.: US 8,943,928 B2
(45) Date of Patent: Feb. 3, 2015

(54) RATCHET WHEEL WRENCH

(75) Inventor: Li Feng, Jiubao Town (CN)

(73) Assignee: Zhejiang Yiyang Tool Manufacture Co., Ltd., Quzhou (CN)

( * ) Notice: Subject to any disclaimer, the term of this patent is extended or adjusted under 35 U.S.C. 154(b) by 0 days.

(21) Appl. No.: 12/931,878

(22) Filed: Feb. 14, 2011

(65) Prior Publication Data

US 2012/0222523 A1 Sep. 6, 2012

(51) Int. Cl.
*B25B 13/46* (2006.01)

(52) U.S. Cl.
CPC ..... *B25B 13/463* (2013.01)
USPC ..... 81/60

(58) Field of Classification Search
USPC ..... 81/60, 58, 61–63.2
See application file for complete search history.

(56) References Cited

U.S. PATENT DOCUMENTS

| | | | | |
|---|---|---|---|---|
| 733,185 | A | 7/1903 | Grady | |
| 827,846 | A | 8/1906 | Bowser et al. | |
| 896,607 | A | 8/1908 | Zeller | |
| 898,806 | A | 9/1908 | Walker | |
| 1,040,835 | A | 10/1912 | Abrams | |
| 1,071,424 | A | 8/1913 | Hughes | |
| 1,455,147 | A | 5/1923 | O'Neill | |
| 1,827,202 | A | 10/1931 | Klein | |
| 1,868,840 | A | 7/1932 | McNaught et al. | |
| 2,803,980 | A | 8/1957 | Vogel | |
| 2,817,257 | A * | 12/1957 | Kniser | 81/60 |
| 3,349,653 | A | 10/1967 | Kaufman et al. | |
| 3,838,614 | A | 10/1974 | O'Donnell | |
| 3,939,962 | A | 2/1976 | Gebhardt | |
| 5,636,557 | A | 6/1997 | Ma | |
| 6,263,767 | B1 | 7/2001 | Hu | |
| 6,282,991 | B1 | 9/2001 | Hu | |
| 6,282,992 | B1 | 9/2001 | Hu | |
| 6,305,247 | B1 | 10/2001 | Chen | |
| 6,446,530 | B1 | 9/2002 | Chang | |
| 6,481,315 | B1 | 11/2002 | Chang | |
| 6,539,825 | B1 * | 4/2003 | Lin | 81/60 |
| 6,591,717 | B2 | 7/2003 | Wei | |
| 6,647,832 | B2 | 11/2003 | Hu | |
| 6,748,825 | B2 | 6/2004 | Hsu | |
| 6,779,422 | B2 * | 8/2004 | Chen | 81/60 |
| 6,807,882 | B2 * | 10/2004 | Hu | 81/60 |
| 6,820,520 | B2 | 11/2004 | Chen | |
| 6,854,362 | B1 * | 2/2005 | Huang | 81/60 |
| 6,862,955 | B1 | 3/2005 | Shu-Sui et al. | |
| 6,874,391 | B2 | 4/2005 | Hsien | |

(Continued)

OTHER PUBLICATIONS

U.S. Appl. No. 09/850,285, filed May 2001, Hu.

(Continued)

*Primary Examiner* — Hadi Shakeri
(74) *Attorney, Agent, or Firm* — Perkins Coie LLP

(57) ABSTRACT

This invention relates to a wrench, especially a ratchet wheel wrench. The ratchet wheel wrench includes a wrench head on which a ratchet wheel groove and a crescent groove communicating the ratchet wheel groove are attached, a ratchet wheel is disposed in the ratchet wheel groove, a ratchet tooth support is disposed at one side of in the crescent groove, a spring is disposed at one end of the ratchet tooth support; a reed is disposed at the side in the crescent groove opposite the ratchet tooth support, one end of the reed is mounted in the crescent groove along the inner wall of the crescent groove, a protuberance is disposed at the other side of the reed, the protuberance is disposed in the spring.

4 Claims, 2 Drawing Sheets

(56) References Cited

U.S. PATENT DOCUMENTS

| | | | | |
|---|---|---|---|---|
| 6,925,913 | B2 | 8/2005 | Chen | |
| 7,100,477 | B2 * | 9/2006 | Lee | 81/60 |
| 8,104,381 | B1 * | 1/2012 | Chen | 81/63.2 |
| 8,261,635 | B2 * | 9/2012 | Lee et al. | 81/60 |
| 2003/0213342 | A1 * | 11/2003 | Wu | 81/60 |

OTHER PUBLICATIONS

U.S. Appl. No. 09/957,426, filed Sep. 2001, Lin.
U.S. Appl. No. 11/050,969, filed Feb. 2005, Chen.
U.S. Appl. No. 10/901,598, filed Jul. 2004, Lee.
U.S. Appl. No. 11/723,985, filed Mar. 2007, Lee.
U.S. Appl. No. 12/040,900, filed Mar. 2008, Yang.

* cited by examiner

RATCHET WHEEL WRENCH

BACKGROUND

The present invention relates to a wrench and more specifically to a ratchet wheel wrench.

In the prior art, such ratchet wheel wrenches comprise a ratchet wheel groove and a crescent groove communicating the ratchet wheel groove on the wrench head and a ratchet wheel is mounted in the ratchet wheel groove. A ratchet tooth support is provided in the crescent groove. One side of the ratchet tooth support and teeth engaged with the ratchet wheel while the other side of the ratchet tooth support leans against the side wall of the crescent groove. A cooperating block opposite the ratchet tooth support is located at the side of the crescent groove which leans against the side wall of the crescent groove. Two through holes are provided on corresponding surfaces of the cooperating block and the ratchet tooth support, respectively, in which there are springs inserted.

Such prior art ratchet wheel wrenches are not very convenient because the cooperating block is disposed in the crescent groove. In addition it is difficult and expensive to manufacture either by forging or by conventional welding. Furthermore, holes need to be provided by milling, for example, on the cooperating block and the ratchet tooth support. Hence, such wrenches are difficult and expensive to manufacture.

As disclosed on Chinese patent ZL200720108388.2, the cooperating block in the crescent groove is a magnetic cooperating block, fixing the spring by magnetism. This patent does not provide for milling holes into the cooperating block, while the cooperating block is not fixed firmly in the crescent groove so that the magnetism of the cooperating block may fade away and causing the spring to be ineffective.

OBJECTS

The object of this invention lies in supplying a ratchet wheel wrench that will insure that the cooperating block is mounted in the crescent groove simply and firmly.

Thus the present invention provides a ratchet wheel wrench, having a wrench head on which a ratchet wheel groove and a crescent groove communicating with the ratchet wheel groove are attached. The ratchet wheel is disposed in the ratchet wheel groove and a ratchet tooth support is disposed at one side of in the crescent groove. A spring is provided at one end of the ratchet tooth support and a reed is mounted in the crescent groove at the side opposite the ratchet tooth support. One end of the reed is firmly mounted in the crescent groove along the inner wall of the crescent groove and a protuberance is disposed at the other side of the reed mounted in the spring. Preferably, the width of the protuberance is larger than ⅔ of the inner diameter of the spring and less than the inner diameter of the spring. Also, preferably, a tuber or projection is disposed at the end of the ratchet tooth support near the spring with the tuber is mounted in the spring.

DRAWINGS

DESCRIPTION

Figure 1:
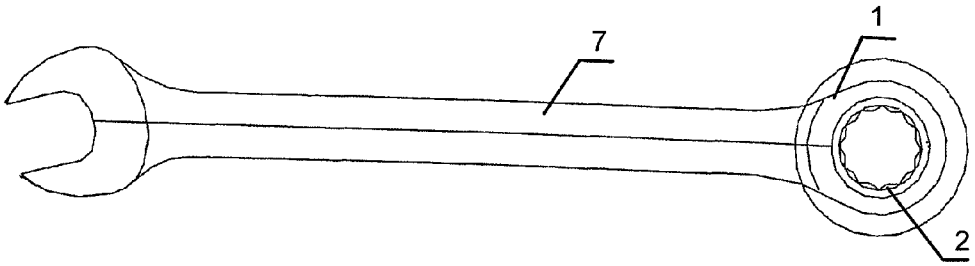
FIG. 1 is a plan view of the ratchet wheel wrench of the present invention.
Figure 2:
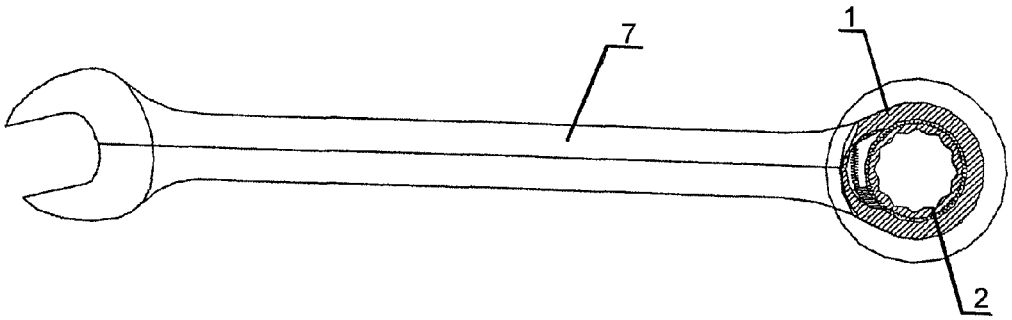
FIG. 2 is a partially transparent view of the ratchet wheel wrench of FIG. 1.
Figure 3:
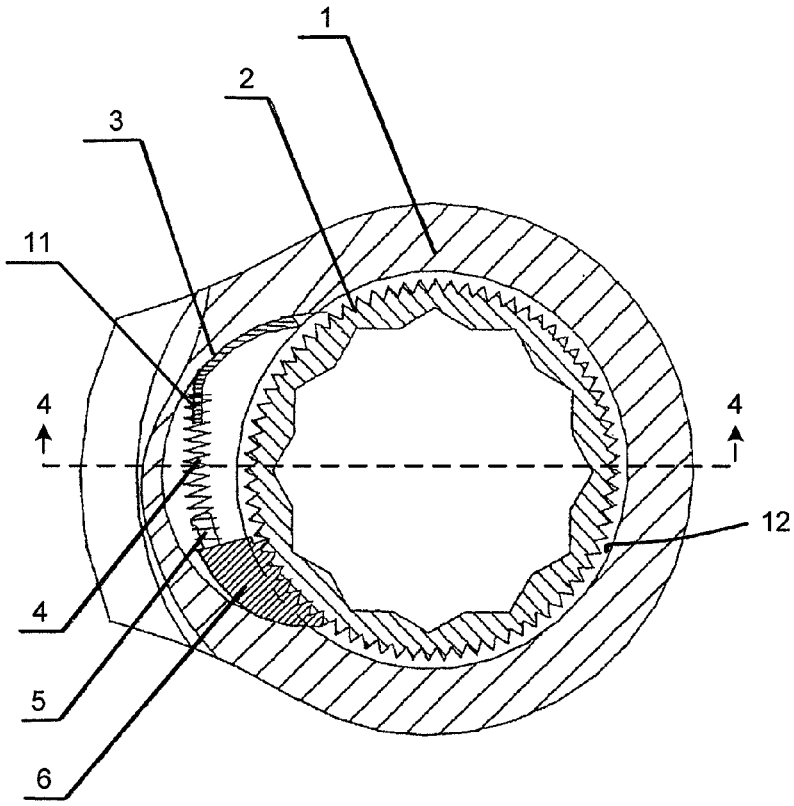
FIG. 3 is an enlarged view of a portion of FIG. 2.
Figure 4:
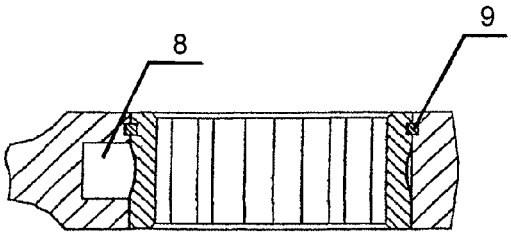
FIG. 4 is a sectional view taken along line 4-4 of FIG. 3.
Figure 5:
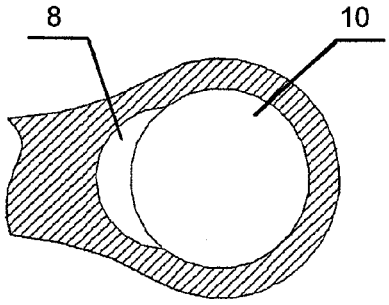
FIG. 5 is a plan view of the ratchet wheel groove and the crescent groove.

As indicated in FIGS. 1-5, the ratchet wheel wrench of the present invention comprises a wrench body 7 at one end of which is a wrench head 1 having a ratchet wheel groove 10 and a crescent groove 8 communicating with the ratchet wheel groove 10. A retainer ring 9 is mounted in the ratchet wheel groove 10 and a ratchet wheel 2 is provided in the ratchet wheel groove 10 through the retainer ring 9. The ratchet wheel 2 is free to rotate within to the ratchet wheel groove 10. A ratchet tooth support 6 is mounted on one side of in the crescent groove 8. On one side of the ratchet tooth support 6 there are teeth 12 engaging the ratchet wheel 2 and the other side of the ratchet tooth support 6 leans against the side wall of the crescent groove 8. A tuber 5 is disposed at the end of the ratchet tooth support 6 and is mounted in a spring 4. A reed 3 is disposed at the side in the crescent groove 8 opposite the ratchet tooth support 6 and has one end of the reed 3 is firmly attached to crescent groove 8 along the inner wall of the crescent groove 8. A protuberance 11 of the reed 3 is disposed at the outer end of the reed 3 is disposed in the spring 4. The width of the protuberance 11 is larger than ⅔ of the inner diameter of the spring 4 and less than the inner diameter of the spring 4.

When using the ratchet wheel wrench, the wrench head 1 is applied to a bolt or a nut, and rotated clockwise. The teeth 12 of ratchet wheel 2 engage with the ratchet tooth support 6. The spring 4 is moved against the ratchet tooth support 6, so as to cause ratchet wheel 2 to rotate, such that the ratchet wheel 2 drives the bolt or nut to rotate. When the wrench is moved back, the ratchet tooth support 6 slips out of the ratchet wheel 2 and the ratchet tooth support 6 is separated from the ratchet wheel 2. Hence, wrench head 1 rotates reversely but the ratchet wheel 2 does not rotate so that the bolt or nut does not rotate reversely. When the wrench head 1 is moved back and is rotated clockwise, the bolt or nut rotates again. This procedure is repeated until the nut is tightened. If the bolt or nut is to be loosened, the ratchet wheel wrench is rotated anti-clockwise.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A ratchet wheel wrench, comprising:

a wrench head having a ratchet wheel groove; and a crescent groove communicating with the ratchet wheel groove, wherein the crescent groove has a first end portion and a second end portion and includes a sidewall forming a crescent curve therebetween;

a ratchet wheel having a first plurality of teeth, wherein the ratchet wheel is positioned in the ratchet wheel groove;

a ratchet tooth support having a second plurality of teeth and a tuber, wherein the ratchet tooth support is positioned in the second end portion of the crescent groove and the second plurality of teeth are positioned to releasably engage the first plurality of teeth;

a reed having an elongated shape, a first end and a second end, wherein the first end extends from the first end portion of the crescent groove directly towards the second end portion, wherein the second end of the reed includes a protuberance, wherein the reed extends along the crescent curve on the sidewall, and wherein the reed between the first end and the protuberance is firmly mounted to the sidewall of the crescent groove; and a spring operably coupled to the ratchet tooth support via the tuber and to the reed via the protuberance, wherein the spring is positioned to bias the ratchet tooth support towards the ratchet wheel to engage the first plurality of teeth with the second plurality of teeth.

2. The ratchet wheel wrench of claim 1 wherein the protuberance includes a width, wherein the spring includes an inner diameter, and wherein the width of the protuberance is greater than ⅔ of the inner diameter of the spring and less than the inner diameter of the spring.

3. The ratchet wheel wrench of claim 1 wherein the spring includes an opening, and wherein the protuberance is positioned at least partially within the opening.

4. The ratchet wheel wrench of claim 2 wherein the spring includes an opening, and wherein the protuberance is positioned at least partially within the opening.

* * * * *